US010643808B2

(12) United States Patent
Falkingham

(10) Patent No.: US 10,643,808 B2
(45) Date of Patent: May 5, 2020

(54) VACUUM SWITCHING DEVICES

(71) Applicant: S&C Electric Company, Chicago, IL (US)

(72) Inventor: Leslie Thomas Falkingham, Rugby (GB)

(73) Assignee: S&C Electric Company, Chicago, IL (US)

( * ) Notice: Subject to any disclaimer, the term of this patent is extended or adjusted under 35 U.S.C. 154(b) by 21 days.

(21) Appl. No.: 16/155,114

(22) Filed: Oct. 9, 2018

(65) Prior Publication Data

US 2020/0111630 A1 Apr. 9, 2020

(51) Int. Cl.
*H01H 33/664* (2006.01)

(52) U.S. Cl.
CPC ..... *H01H 33/6642* (2013.01); *H01H 2203/05* (2013.01)

(58) Field of Classification Search
CPC ..... H01H 33/6642; H01H 33/664; H01H 33/6643; H01H 33/6644; H01H 33/6645
USPC ..... 218/142, 123, 127, 128, 129, 118
See application file for complete search history.

(56) References Cited

U.S. PATENT DOCUMENTS 4,532,391 A 7/1985 Bernt
4,629,839 A 12/1986 Falkingham
4,675,483 A * 6/1987 Gebel ..... H01H 33/6642 218/129
4,935,588 A * 6/1990 Hess ..... H01H 1/0206 218/123
5,064,976 A * 11/1991 Bialkowski ..... H01H 33/6642 218/127
5,099,093 A * 3/1992 Schels ..... H01H 33/6642 218/128
6,479,778 B1 11/2002 Kumura et al.
6,479,779 B1 * 11/2002 Falkingham ..... H01H 33/6642 218/123
6,639,169 B2 * 10/2003 Matsui ..... H01H 33/6642 218/123

(Continued)

FOREIGN PATENT DOCUMENTS

CN 102751131 A 10/2012
DE 3840825 A1 6/1990

(Continued)

OTHER PUBLICATIONS

Translation of CN102751131 (Original document published Oct. 24, 2012) (Year: 2012).*

*Primary Examiner* — William A Bolton

(57) ABSTRACT

A vacuum switching device may have at least one cup-shaped contact closed by a disc of contact material and a conical mechanical support, which acts to prevent the contact disc from becoming concave. The cup-shaped contact may include a plurality of slots in the sidewalk that extend into the base of the cup, the slots oriented to produce an axial magnetic field when current flows through the contacts. The support may be made of a metal that is a poor conductor of electricity. The narrow end of the cone may be capped by a circular ring or disc, and the wide end may be formed with a flange. The flange may be circular and may be sized and formed to locate the cone centrally in the base of the contact cup. The cone may have apertures to facilitate the evacuation of gas inside the cone.

4 Claims, 2 Drawing Sheets

(56) References Cited

U.S. PATENT DOCUMENTS

| | | | | |
|---|---|---|---|---|
| 6,649,855 | B2 * | 11/2003 | Nishijima ..... | H01H 33/6642 218/123 |
| 6,765,168 | B2 * | 7/2004 | Takebuchi ..... | H01H 33/6642 218/118 |
| 2004/0050819 | A1 | 3/2004 | Matsui et al. | |

FOREIGN PATENT DOCUMENTS

| | | | |
|---|---|---|---|
| DE | 4119706 | A1 | 1/1992 |
| GB | 2552839 | A | 2/2018 |

* cited by examiner

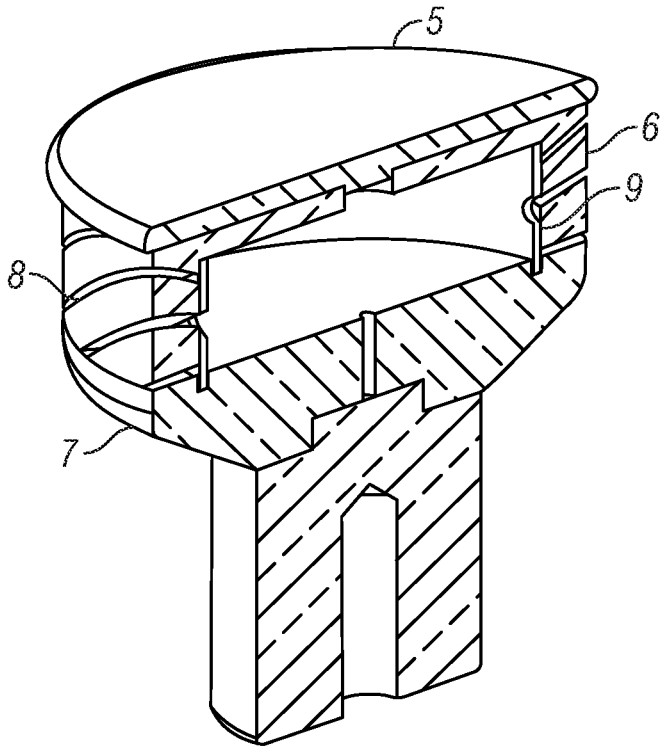
FIG. 3 - Prior Art

VACUUM SWITCHING DEVICES

TECHNICAL FIELD

This invention relates to improvements in vacuum switching devices, which may include, for example, vacuum interrupters or vacuum switches. The invention is illustrated in FIG. 1.

BACKGROUND

Vacuum switching devices which are designed to switch large currents have been produced for many years. Vacuum switching devices, generally consist of an evacuated envelope which includes an insulating component, a fixed electrode assembly and a moving electrode assembly. The two electrodes are engaged and disengaged mechanically to perform the switching function. It is necessary for this movement to occur without breaking the seal of the evacuated envelope, which is normally achieved by means of a bellows or diaphragm arrangement. The electrodes are made of a metal with good electrical conductivity such as copper. The contact faces are in the form of discs made of special material best able to withstand erosion by the arc which forms as the contacts are separated.

As the electrodes separate in switching, an electric arc forms. Due to aspects of the physics of the vacuum arc, the arc is diffused over the contact surfaces at low currents but becomes constricted to a small area or areas of the contact surfaces at a current of a few thousands of amps. It is necessary to control this constriction of the arc, which would inhibit successful interruption of the current due to overheating of points on the contact surfaces. This is achieved by constraining the current flow leading up to the contact surfaces to follow a helical path such that the magnetic field associated with the current influences the arc in a desired way. In one known form the magnetic field is generally radial over the contact surfaces, and in another known form the field is generally spread over the contact area and in the direction of the axis of the assembly. This invention concerns the axial field form of contacts.

A number of different designs of axial field electrodes and electrode assemblies have been proposed. Examples of such designs may be seen in EP 0349303, DE 3915519, DE 3610241, GB 2 338 1111 1 1, and GB2174843. The structure of a known axial field contact is shown in FIG. 3. In this design the contact head of the electrode is cup-shaped, formed from a cylindrical wall part (6) brazed to a disc shaped base (7). The wall part has a plurality of slots (8) formed in a generally helical direction. The wall part of the cup supports a contact disc (5). When current flows through the electrodes and an arc is formed between them, the slots constrain the current to take a helical path around the axis of the assembly, whereby a significant magnetic field is generated in a direction parallel to the axis of the contacts. This axial field acts to diffuse an arc that would otherwise be constricted and so enables higher currents to be interrupted. In some recent designs slots are cut into the base of the contact cup as well.

A disadvantage of these design is this type of design is that the slots mechanically weaken the contact assembly and so some means of mechanical support may be necessary to help support the contact disc and prevent mechanical distortion of the contact. In FIG. 3 this support takes the form of a cylinder of strong metal (9) of relatively poor electrical conductivity, which prevents collapse of the slotted outer part of the contact. Another approach to the problem is to allow the distortion to occur, and the slots to partially close, but to allow for the consequent shortening of the contact cup in the design and use of the vacuum switching device.

BRIEF DESCRIPTION OF THE DRAWINGS

FIG. 3 is a perspective view partially cut away of contacts suitable for use in a vacuum interrupter device in accordance with the herein described embodiments.

DETAILED DESCRIPTION

This invention however addresses a different form of distortion of the contact. Experiments carried out by us show. Unfortunately it is known that after a small number of high current switching operations the contact disk tends to deform from a flat form to a form concave towards the base of the contact cup. This is caused by forces arising from the arc and also by the fact that the contact disc of suitable alloy is often backed by a disc of copper. These two materials have different thermal expansion coefficients, resulting in a force causing dishing concave form. This distortion has a very negative effect on the life of the device and also reduces the effectiveness of the magnetic field and the current carrying capacity of the contact disk. It also leads to significantly increased electrical wear at the edges of the contact disk. In order to overcome this deformation of the contact disc during the lifetime of the device it is necessary in known devices to design the contact assembly to be larger than otherwise needed in order to accommodate reduced switching capacity as the number of switching operations accumulates. A larger contact assembly means the whole switching device must be larger, thus substantially adding to the cost of the device.

In a new contact design as shown in FIG. 3 which is intended to have improved switching capability the wall part and the base part of the contact cup are formed from one piece of metal and slots cut into the wall extend partly into the base portion 7 in a chordal direction 10. In FIG. 3 the contact disc 5 is shown separated to reveal the slots, but in reality the disc is fixed to the contact cup.

This design with the slots extending into the base portion may be weaker mechanically than the prior art previously described. In accordance with the herein described embodiments, a new form of strengthening may be provided.

Figure 1:
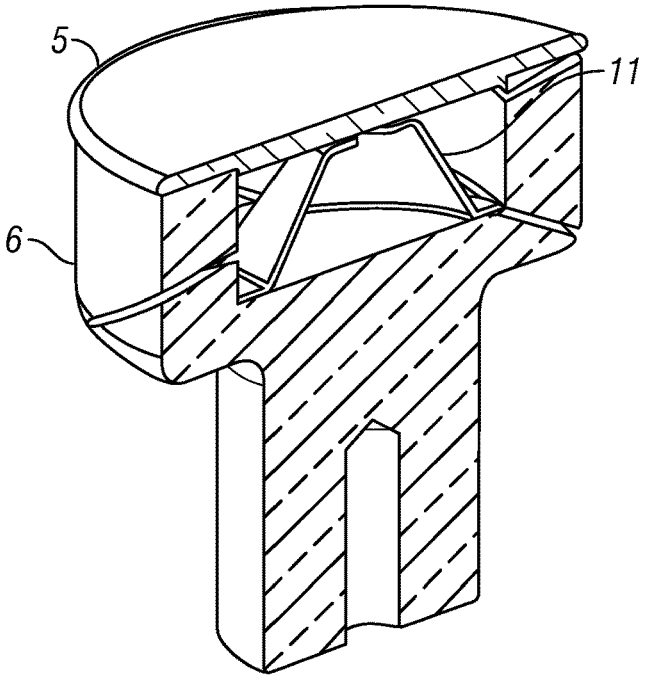
FIG. 1 is a perspective view partially cut away of contacts suitable for use in a vacuum interrupter device in accordance with the herein described embodiments.
Figure 2:
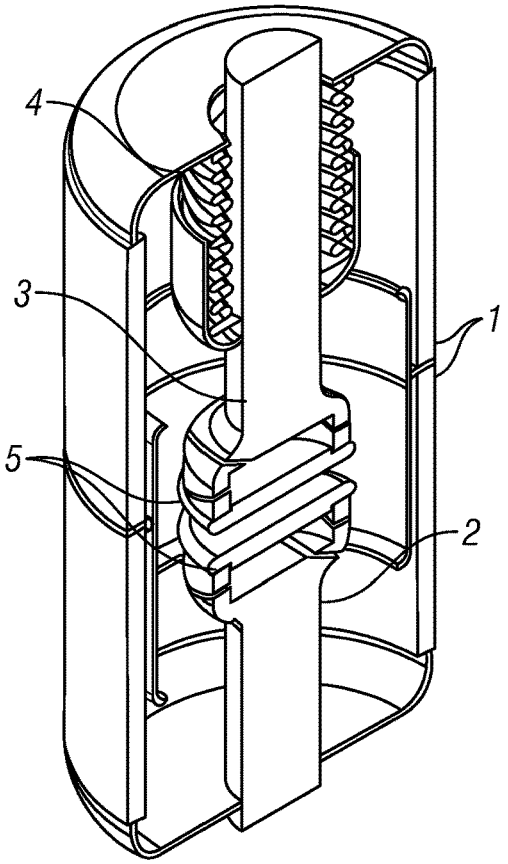
FIG. 2 is a perspective view partially cut away of a vacuum interrupter device in accordance with the herein described embodiments.

According to the herein described embodiments, the contact disc of a slotted axial field contact assembly has a central support in the form of a truncated hollow cone as shown in FIG. 1. The cone 11 is relatively thin-walled and is preferably made of a relatively strong material of relatively poor electrical conductivity, such as stainless steel.

The preferred form is a straight sided cone but cones whose sides are curved inwards or outwards or stepped or ridged are also possible. Preferably the narrow end of the cone supports the contact disc and the wide end of the cone rests against the base of the cup.

A conical shape is stronger than a cylindrical shape because a cone benefits from hoop stresses and will buckle at a significantly higher axial force than a cylinder made of similar material. The conical support is sufficiently effective that the cylindrical support in found in prior art and mentioned above may be dispensed with.

The narrow end of the cone may be bridged by a disc or a ring shape, to provide support over a reasonable area to the underside of the contact disc, and to add strength to that part of the cone. The wide end of the cone may be formed with a flange to add rigidity to the cone shape, to help locate the cone and to spread the force with which the cone presses into the softer metal of the base of the cup. The cone may be provided with holes or slots to assist in the escape of gas during vacuum pumping.

As described herein, a vacuum switching device may have at least one cup-shaped contact closed by a disc of contact material 5 and a conical mechanical support, which acts to prevent the contact dis from becoming concave. The cup-shaped contact may include a plurality of slots in the sidewalls that extend into the base of the cup, the slots oriented to produce an axial magnetic field when current flows through the contacts. 50% of the slots may extend into the base of the contact. The slots may have an angle of between 45° and 82° relative to the axis of the contacts. The support may be made of a metal that is a poor conductor of electricity, such as stainless steel, or of glass or ceramic material. The cone angle may be between 20° and 140°. The narrow end of the cone may be capped by a circular ring or disc, and the wide end may be formed with a flange. The flange may be circular and may be sized and formed to locate the cone centrally in the base of the contact cup. The cone may have apertures to facilitate the evacuation of gas inside the cone.

What is claimed is:

1. A vacuum switching device comprising of an evacuated envelope which includes an insulating component, a fixed electrode and a moving electrode which are designed to engage and disengage mechanically to perform a switching function and which includes two cup-shaped contacts each closed by a contact disc of contact material, with a plurality of slots in a sidewalls of the cup or in a base of the cup, or in both, the slots being oriented to produce an axial magnetic field when current flows through the contacts, and a mechanical support having a hollow truncated cone shape with a first, truncated end bridged by an annular ring formed integral to a side wall portion of the mechanical support, and a wide end of the truncated cone having a flange formed integral to the side wall portion and extending radially outward from the side wall, wherein, the mechanical support is located by fitting the truncated end of the cone into a depression formed in a surface of the contact disc and the truncated cone with the annular ring and flange act in combination mechanically to prevent the contact disc from becoming concave.

2. The vacuum switching device as described in claim 1 in which the flange is in the form of an annular disc.

3. The vacuum switching device as described in claim 1 in which the flange is sized and formed so as to locate the cone centrally in the base of the contact cup.

4. The vacuum switching device as described in claim 1 in which the cone has an aperture or apertures to facilitate evacuation of gas from an inside portion of the cone.

* * * * *